US010522059B1

(12) United States Patent
Greilanger

(10) Patent No.: US 10,522,059 B1
(45) Date of Patent: Dec. 31, 2019

(54) SIGN HOLDING ASSEMBLY

(71) Applicant: Benjamin Clifford Greilanger, St. Paul, MN (US)

(72) Inventor: Benjamin Clifford Greilanger, St. Paul, MN (US)

( * ) Notice: Subject to any disclaimer, the term of this patent is extended or adjusted under 35 U.S.C. 154(b) by 0 days.

(21) Appl. No.: 16/430,932

(22) Filed: Jun. 4, 2019

(51) Int. Cl.
*G09F 7/18* (2006.01)

(52) U.S. Cl.
CPC ..... *G09F 7/18* (2013.01); *G09F 2007/1817* (2013.01); *G09F 2007/1852* (2013.01)

(58) Field of Classification Search
CPC ..... G09F 7/18; G09F 2007/1804; G09F 2007/1813; G09F 2007/1817; G09F 2007/1852; G09F 2007/1847
See application file for complete search history.

(56) References Cited

U.S. PATENT DOCUMENTS 2,383,881 A * 8/1945 Murphy ..... G09F 7/18 40/607.12
3,525,493 A * 8/1970 Newell ..... F16B 5/0614 248/220.21
3,552,702 A * 1/1971 Springer ..... G09F 7/18 248/316.7
4,548,377 A * 10/1985 Huel ..... G09F 7/18 248/219.1
4,706,400 A 11/1987 Howard
5,335,889 A * 8/1994 Hopkins ..... G09F 7/18 248/219.4
5,794,906 A * 8/1998 Harris ..... G09F 7/18 248/317
6,186,454 B1 2/2001 Olsen
8,117,775 B2 2/2012 Hedditch
8,863,419 B1 * 10/2014 Pace ..... G09F 15/00 248/218.4
2002/0096610 A1 * 7/2002 Fernandez ..... G09F 7/18 248/218.4
2003/0213153 A1 * 11/2003 Kim ..... G09F 7/18 40/607.14
2005/0029419 A1 * 2/2005 Ware ..... F16L 3/137 248/218.4
2006/0163301 A1 * 7/2006 Rhodes ..... A61J 9/06 224/409
2006/0175492 A1 * 8/2006 Cooper ..... A62B 9/04 248/229.17
2008/0245938 A1 * 10/2008 Qualy ..... F16M 13/02 248/218.4

(Continued)

FOREIGN PATENT DOCUMENTS

GB 1461111 1/1977
GB 2462145 2/2010

*Primary Examiner* — Gary C Hoge

(57) ABSTRACT

A sign holding assembly includes a base that has a back side, a front side and a perimeter edge extending between the inner and front sides. The perimeter edge includes a top edge, a bottom edge, a first lateral edge and a second lateral edge. The back side is concavely arcuate from the first lateral edge to the second lateral edge. A receiver is attached to and extends away from the front side. The receiver receives and engages a sign such that the sign extends outwardly away from the front side. A strap is attached to the base and is extendable around a vertical support to releasably secure the base to the vertical support such that the inner surface faces the vertical support.

10 Claims, 6 Drawing Sheets

(56) References Cited

U.S. PATENT DOCUMENTS

| | | | | |
|---|---|---|---|---|
| 2009/0084919 | A1* | 4/2009 | Hillstrom | F16B 12/42 248/309.1 |
| 2009/0146029 | A1* | 6/2009 | Beatty | G09F 7/18 248/206.5 |
| 2009/0230266 | A1* | 9/2009 | Hillstrom | G09F 7/18 248/230.9 |
| 2009/0265970 | A1* | 10/2009 | Hedditch | G09F 7/18 40/607.13 |
| 2011/0271571 | A1* | 11/2011 | Lennard | G09F 7/18 40/606.01 |
| 2013/0071207 | A1 | 6/2013 | Edgington | |
| 2016/0055775 | A1* | 2/2016 | Landwehr | G09F 7/18 40/609 |
| 2018/0064265 | A1* | 3/2018 | Shea | A47F 5/0823 |

* cited by examiner

SIGN HOLDING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sign display device and more particularly pertains to a new sign display device for allowing a person to display a sign from any vertically orientated support such as trees and light poles, for example.

(2) Description of Related Art Including Information Disclosed Under 37 CFR 1.97 and 1.98

The prior art relates to sign display devices utilizing a variety of structures to support signage.

BRIEF SUMMARY OF THE INVENTION

An embodiment of the disclosure meets the needs presented above by generally comprising a base that has a back side, a front side and a perimeter edge extending between the inner and front sides. The perimeter edge includes a top edge, a bottom edge, a first lateral edge and a second lateral edge. The back side is concavely arcuate from the first lateral edge to the second lateral edge. A receiver is attached to and extends away from the front side. The receiver is configured to receive and engage a sign such that the sign extends outwardly away from the front side. A strap is attached to the base and is configured to be extendable around a vertical support to releasably secure the base to the vertical support such that the inner surface faces the vertical support.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
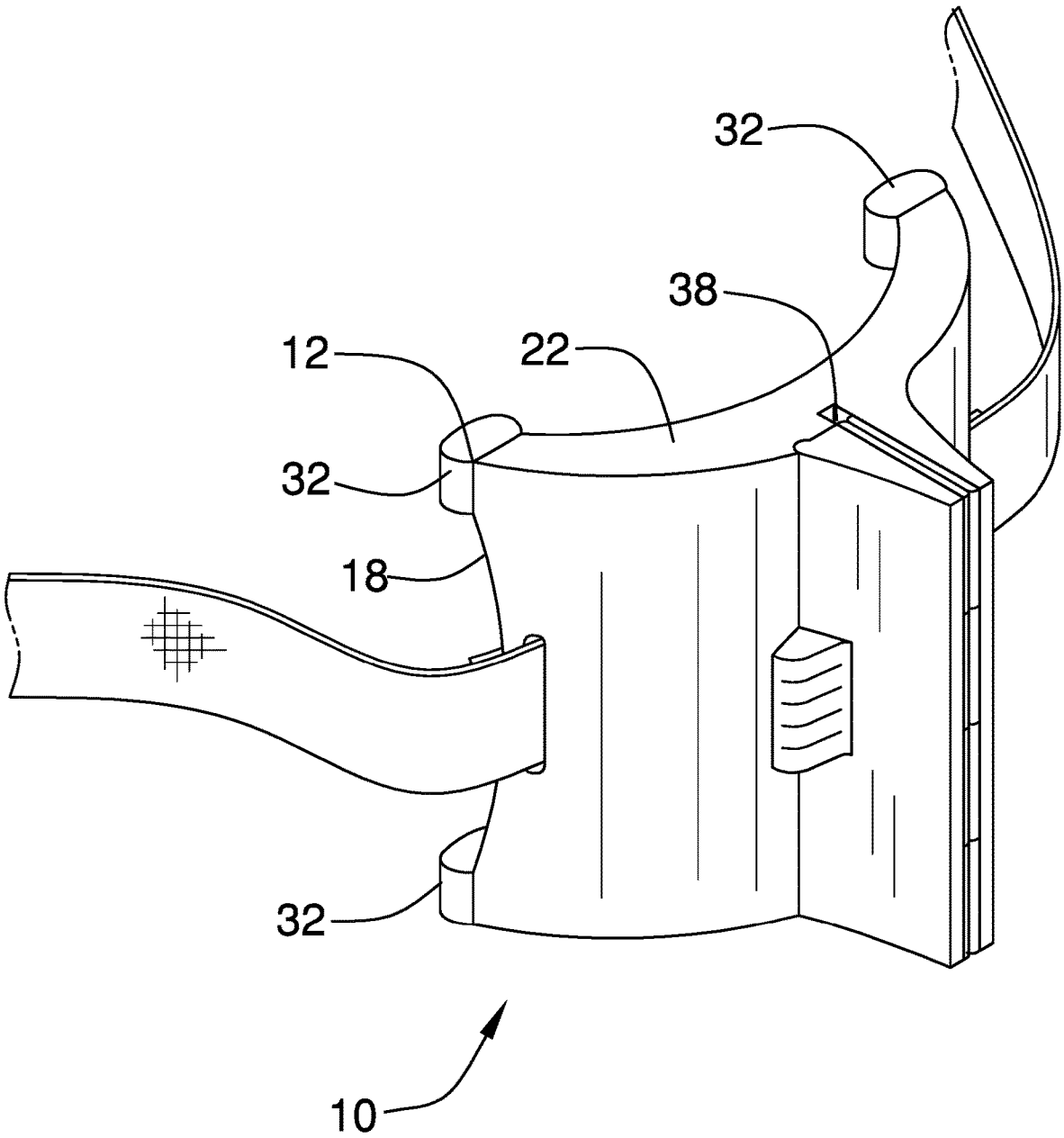
FIG. 1 is a front isometric view of a sign holding assembly according to an embodiment of the disclosure.
Figure 2:
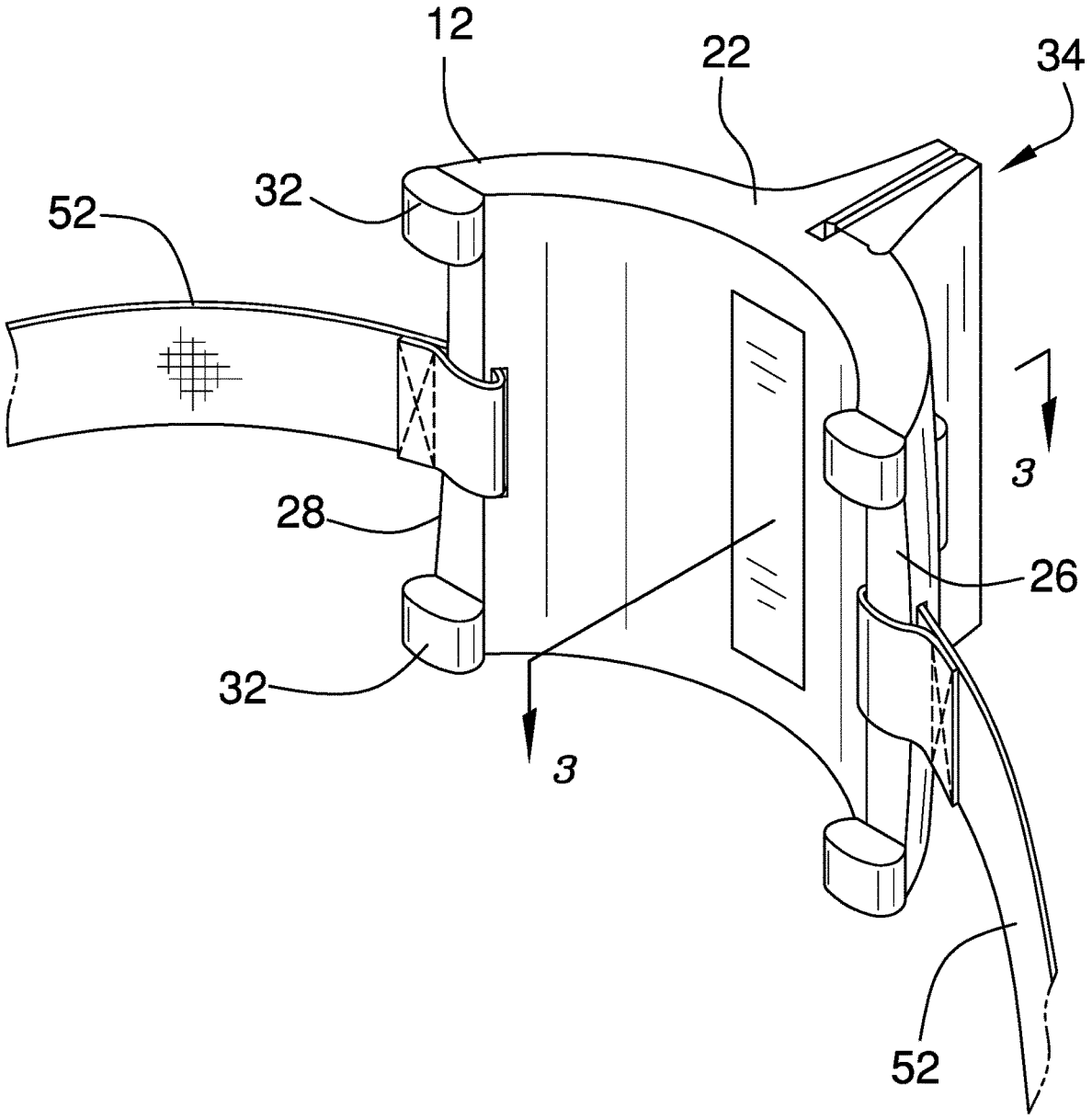
FIG. 2 is a rear isometric view of an embodiment of the disclosure.

With reference now to the drawings, and in particular to FIGS. 1 through 6 thereof, a new sign display device embodying the principles and concepts of an embodiment of the disclosure and generally designated by the reference numeral 10 will be described.

As best illustrated in FIGS. 1 through 6, the sign holding assembly 10 generally comprises a base 12 that has a back side 14, a front side 16 and a perimeter edge 18 extending between the back 14 and front 16 sides. The perimeter edge 18 includes a top edge 22, a bottom edge 24, a first lateral edge 26 and a second lateral edge 28. The back side 14 is concavely arcuate from the first lateral edge 26 to the second lateral edge 28. As can be seen in the Figures, this shape causes the junctures of the top 22 and bottom 24 edges with the back side 14 to be concavely arcuate as well. This arcuate shape allows the base 12 to more easily contour to a vertical support 30 that is cylindrical or nearly cylindrical. The base 12 may be comprised of a rigid material such as plastic, metal, or similar materials. The base 12 may have a width from the first lateral edge 26 to the second lateral edge 28 between 3.0 inches and 12.0 inches and a height from the bottom edge 24 to the top edge 22 between 3.0 inches and 12.0 inches. A plurality of feet 32 is attached to and extends downwardly from the back side 14. The back side 14 has four corners and each of the corners has one of the feet 32 positioned adjacent thereto. The feet 32 may be comprised of a rigid material similar to the base or may be comprised of a friction enhancing material such an elastomeric material.

Figure 3:
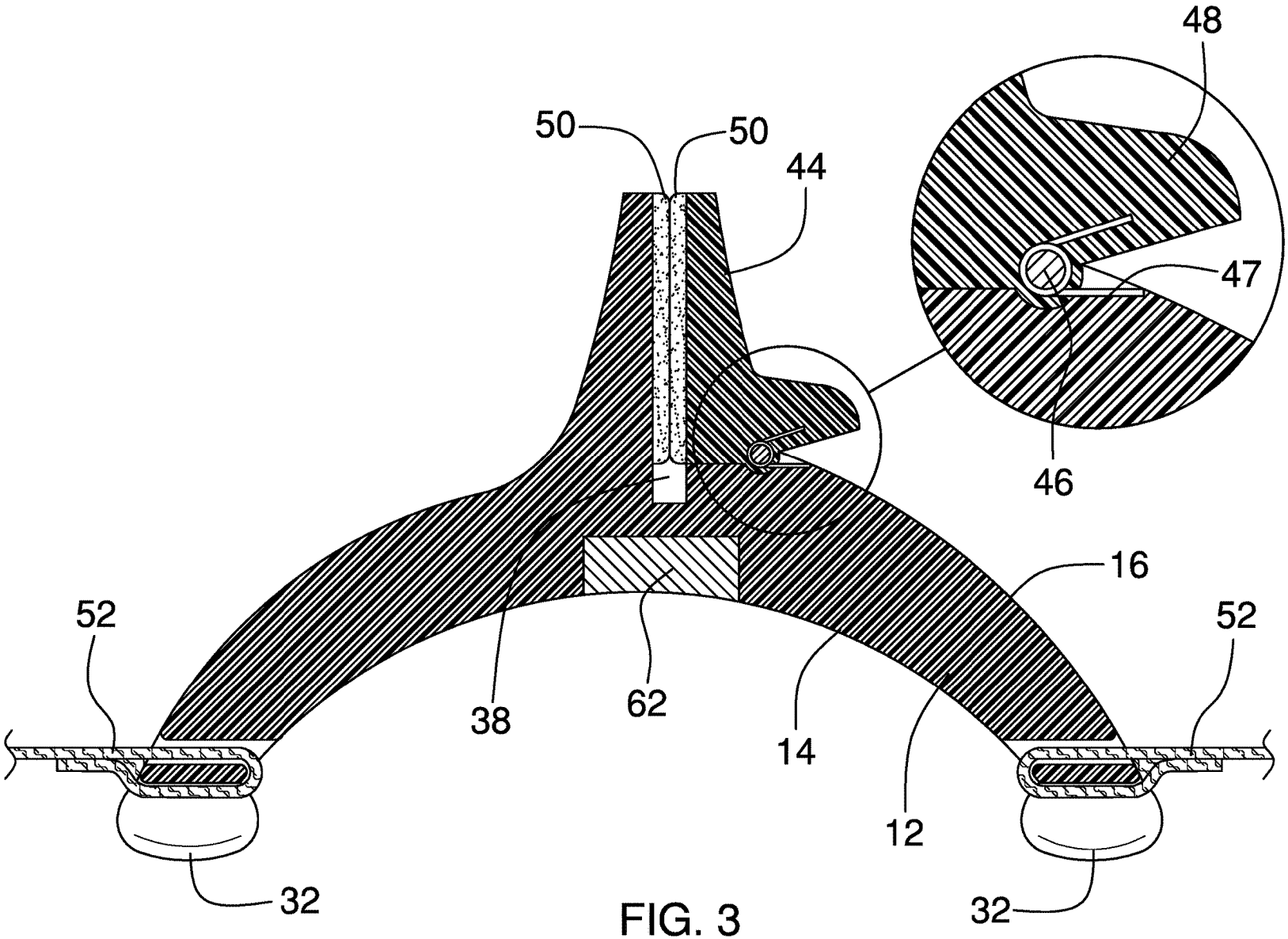
FIG. 3 is a cross-sectional view of an embodiment of the disclosure taken along line 3-3 of FIG. 2.
Figure 4:
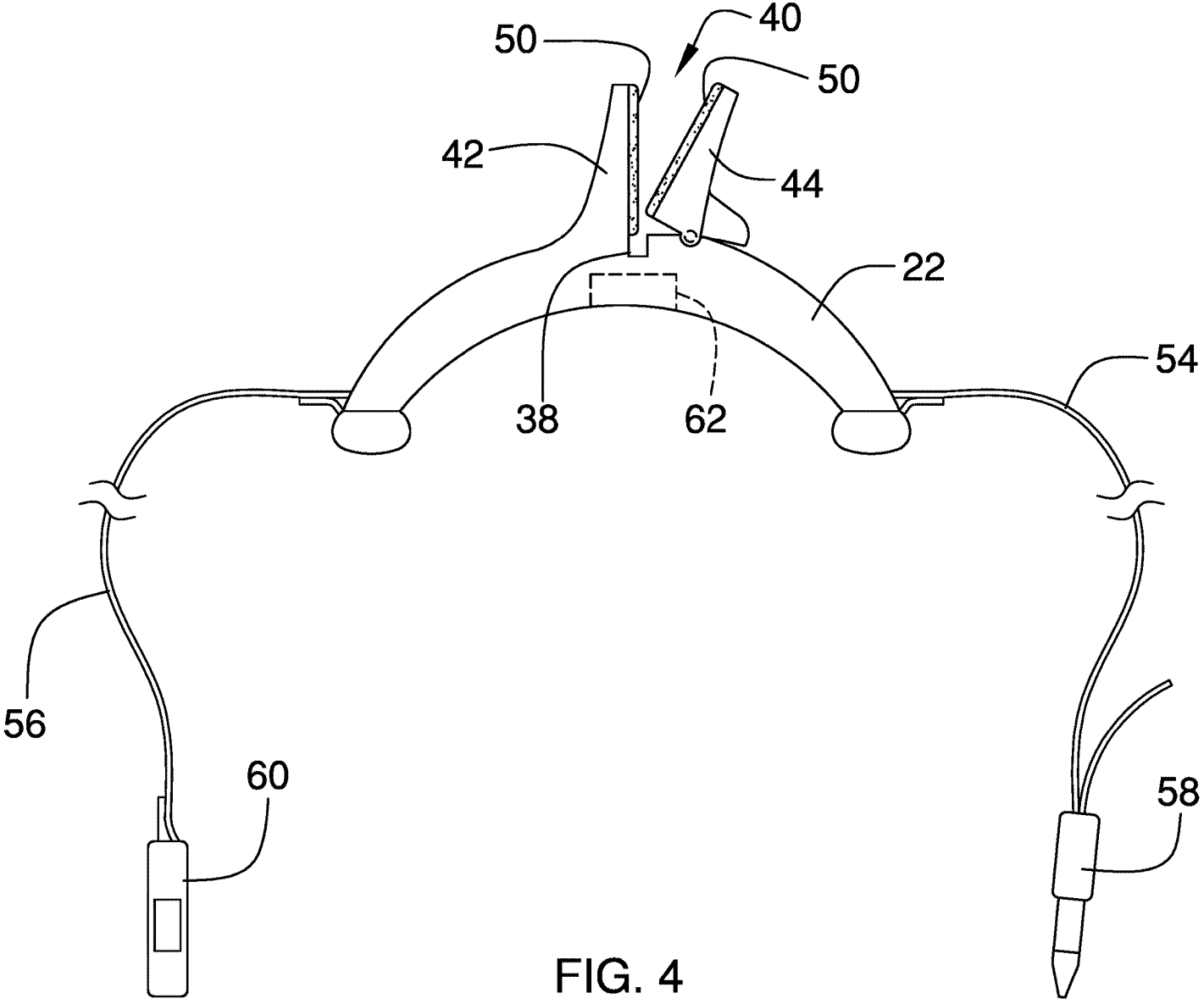
FIG. 4 is a top view of an embodiment of the disclosure.

A receiver 34 is attached to and extends away from the front side 16. The receiver 34 is configured to receive and engage a sign 36 such that the sign 36 extends outwardly away from the front side 16. The receiver 34 may bound a slot 38 extending into the front side and which further extends through the top 22 and bottom 24 edges. The slot 38 is centrally located in the front side 16 and receives a side edge 37 of the sign 36 when the sign 36 is placed in the receiver 34. The receiver 34 includes an elongated opening 40 which is vertically orientated and extends from the top edge 22 to the bottom edge 24 such that the opening 40 receives the side edge 37 of the sign 36 when the side edge 37 is vertically orientated. The receiver 34 may include a clamp having a first wall 42 and a second wall 44 that are each attached to and extend outwardly away from the front side 16. The first 42 and second 44 walls are biased toward each other to frictionally engage the sign 36 when the sign 36 is positioned between the first and second walls. The first wall 42, as shown in FIG. 3, may be fixedly coupled to the base 12. The second wall 44 is pivotally coupled to the base 12. The second wall 44 may be pivotally coupled by a spindle 46, axle or hinge to the base 12 wherein a tension spring 47 may be utilized to bias the second wall 44 toward the first wall 42. Alternatively a living hinge may be utilized such as employing a resiliently bendable connective material between the second wall 44 and the base 12. A grip 48 is attached to the second wall 44 to facilitate urging the second wall 44 away from the first wall 42.

Figure 5:
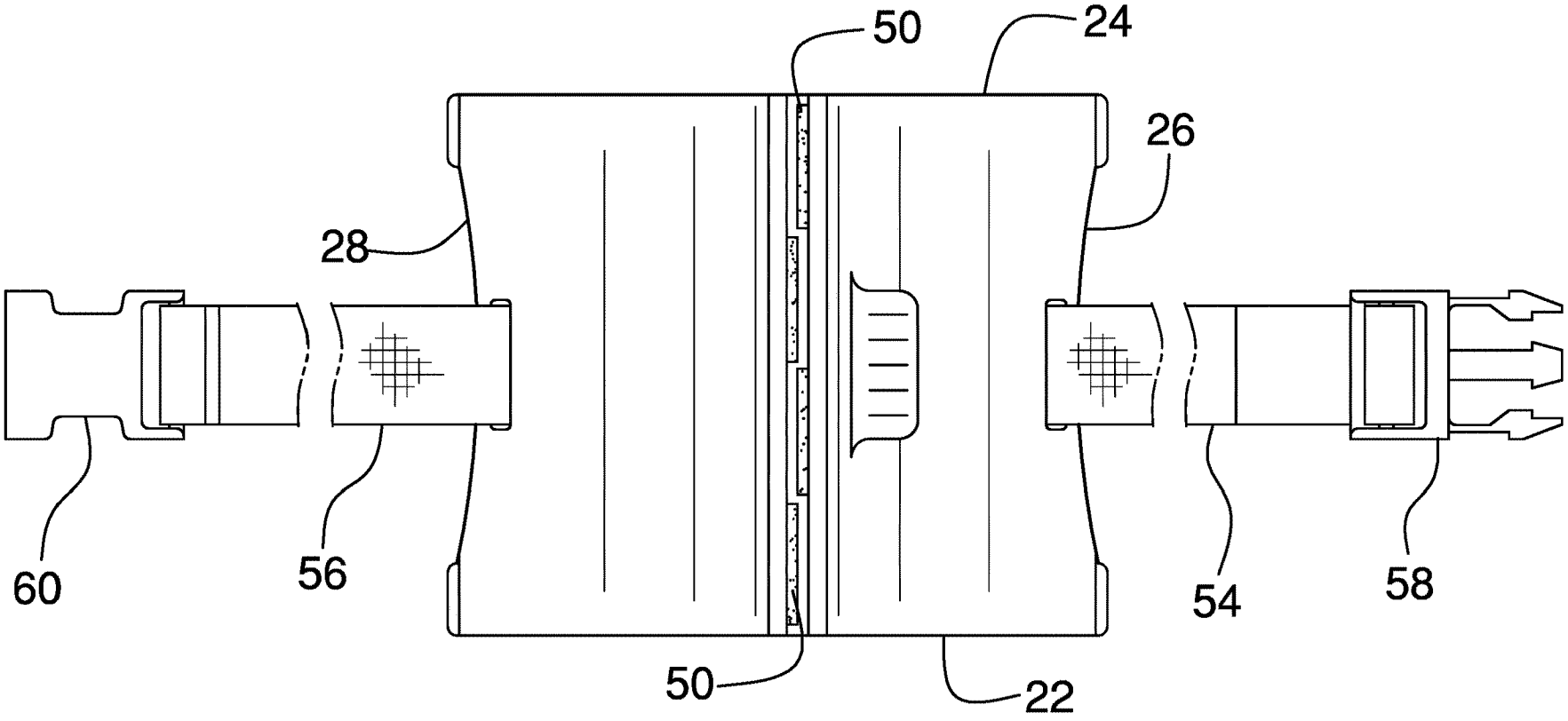
FIG. 5 is a front view of an embodiment of the disclosure.

A plurality of gripping pads 50 is provided. Each of the first 42 and second 44 walls has at least one of the gripping pads 50 attached thereto wherein the gripping pads 50 are positioned between the first 42 and second 44 walls. The gripping pads 50 may be comprised of a resiliently compressible material to prevent damage to the sign 36 when the sign 36 is frictionally held by the receiver 34. The gripping 50 pads may be staggered in positioning as shown in FIG. 5.

Figure 6:
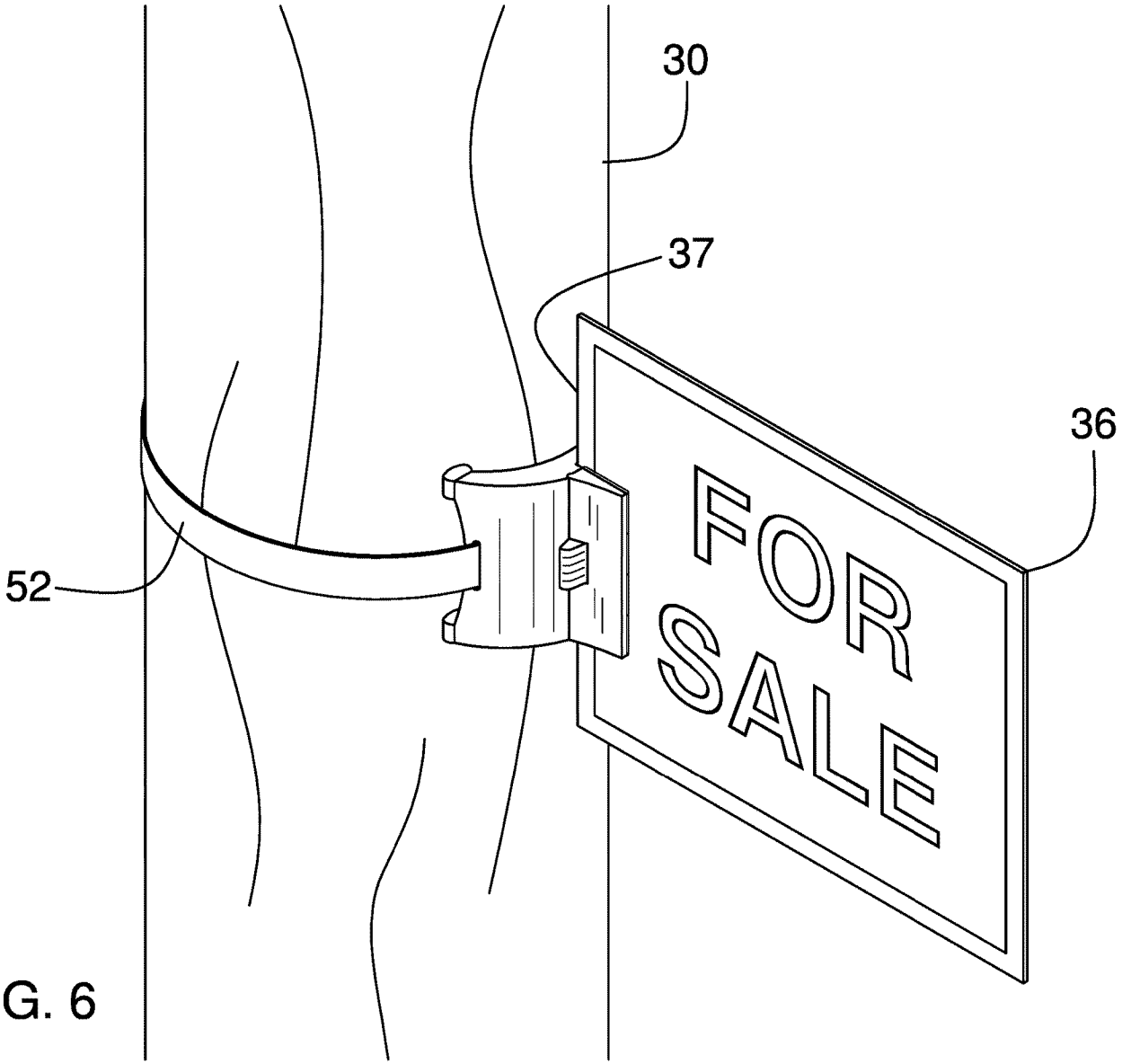
FIG. 6 is a front isometric in-use view of an embodiment of the disclosure.

A strap 52 is attached to the base 12. The strap 52 is configured to be extendable around the vertical support 30 to releasably secure the base 12 to the vertical support 30 such that the back side 14 faces the vertical support 30. The strap 52 extends between the first 26 and second 28 lateral edges and is spaced from the top 22 and bottom 24 edges. As can be seen in the Figures and in particular FIG. 3, the strap 52 may be extended through the base 12. The strap 52 has a break therein and divides the strap 52 into a first portion 54 and a second portion 56. A first mating member 58 is attached to the first portion 54 and a second mating member 60 is attached to the second portion 56. The first 58 and second 60 mating members are removably coupled to each other and may comprise a conventional buckle or clasp assembly. Alternatively, the first 58 and second 60 mating members may include snaps, hook and loop fasteners, and the like. The first mating member 58 may be movable along a length of the first portion 54 to alter the length of the strap 52 when the strap 52 is formed into a closed loop as shown in FIG. 6. The second mating member 60 may also be movable along a length of the second portion 56.

A magnet 62 is mounted in the base 12. The magnet 62 is positioned in a central area of the back side 14. The magnet 62 may be used to help secure the base to a vertical support 30 which is comprised of a metal that is magnetically active.

In use, the base 12 is attached to a tree, street lamp pole, sign pole or other vertical support 30. The receiver 34 is used to engage a sign 36 such that the sign 36 extends laterally away from the base 12. This places the sign 36 in an orientation and location that is easily seen by persons passing by the sign 36. Unlike signs placed in a person's yard, the assembly 10 allows a sign 36 to be placed as vertically high as needed so that, for example, it can be viewed over vehicles parked adjacent to the sign 36. The receiver 34 allows the assembly 10 to release the sign 36 so that it may be used again as needed while the shape of the base 12 ensures that assembly 10 will contour to a rounded, vertically orientated support so that the sign 36 will substantially lie in a vertically orientated plane.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sign displaying apparatus configured to receive and hold a sign on a vertically orientated support, the sign displaying apparatus comprising:

a base having a back side, a front side and a perimeter edge extending between the back and front sides, the perimeter edge including a top edge, a bottom edge, a first lateral edge and a second lateral edge, the back side being concavely arcuate from the first lateral edge to the second lateral edge;

a receiver being attached to and extending away from the front side, the receiver being configured to receive and engage a sign such that the sign extends outwardly away from the front side, the receiver including a clamp including a first wall and a second wall being attached to and extending outwardly away from the front side, the first and second walls being biased toward each other to frictionally engage the sign when the sign is positioned between the first and second walls, the first wall being fixedly coupled to the base, the second wall being pivotally coupled to the base; and a strap being attached to the base, the strap being configured to be extendable around a vertical support to releasably secure the base to the vertical support such that the back side faces the vertical support.

2. The sign displaying apparatus according to claim 1, further including a plurality of feet being attached to and extending downwardly from the back side, the back side having four corners, each of the corners having one of the feet positioned adjacent thereto.

3. The sign displaying apparatus according to claim 1, further including a grip being attached to the second wall to facilitate urging the second wall away from the first wall.

4. The sign displaying apparatus according to claim 1, further including a plurality of gripping pads, each of the first and second walls having at least one of the gripping pads attached thereto wherein the gripping pads are positioned between the first and second walls.

5. The sign displaying apparatus according to claim 1, wherein the strap extends between the first and second lateral edges.

6. The sign displaying apparatus according to claim 5, wherein the strap is spaced from the top and bottom edges.

7. The sign displaying apparatus according to claim 1, wherein the strap has a break therein and divides the strap into a first portion and a second portion, a first mating member being attached to the first portion, a second mating member being attached to the second portion, the first and second mating members being removably coupled to each other.

8. The sign displaying apparatus according to claim 7, wherein the first mating member is movable along a length of the first portion.

9. The sign displaying apparatus according to claim 1, further including a magnet being mounted in the base, the magnet being positioned in a central area of the back side.

10. A sign displaying apparatus configured to receive and hold a sign on a vertically orientated support, the sign displaying apparatus comprising:

a base having a back side, a front side and a perimeter edge extending between the back and front sides, the perimeter edge including a top edge, a bottom edge, a first lateral edge and a second lateral edge, the back side being concavely arcuate from the first lateral edge to the second lateral edge;

a plurality of feet being attached to and extending downwardly from the back side, the back side having four corners, each of the corners having one of the feet positioned adjacent thereto;

a receiver being attached to and extending away from the front side, the receiver being configured to receive and engage a sign such that the sign extends outwardly away from the front side, the receiver including:

a clamp including a first wall and a second wall being attached to and extending outwardly away from the front side, the first and second walls being biased toward each other to frictionally engage the sign when the sign is positioned between the first and second walls, the first wall being fixedly coupled to the base, the second wall being pivotally coupled to the base, a grip being attached to the second wall to facilitate urging the second wall away from the first wall;

a plurality of gripping pads, each of the first and second walls having at least one of the gripping pads attached thereto wherein the gripping pads are positioned between the first and second walls;

a strap being attached to the base, the strap being configured to be extendable around a vertical support to releasably secure the base to the vertical support such that the back side faces the vertical support, the strap extending between the first and second lateral edges, the strap being spaced from the top and bottom edges, the strap having a break therein and dividing the strap into a first portion and a second portion, a first mating member being attached to the first portion, a second mating member being attached to the second portion, the first and second mating members being removably coupled to each other, the first mating member being movable along a length of the first portion; and a magnet being mounted in the base, the magnet being positioned in a central area of the back side.

* * * * *